US006209161B1

(12) United States Patent
Tsung-Ping

(10) Patent No.: US 6,209,161 B1
(45) Date of Patent: Apr. 3, 2001

(54) SHOE INSERT

(76) Inventor: Chen Tsung-Ping, No. 41,Alley 65,Lane 200,Sec. 4, Kuang Fu Rd., Feng Tien Village, Tai Wei Hsiang, Chang Hua Hsien (TW)

( * ) Notice: Subject to any disclaimer, the term of this patent is extended or adjusted under 35 U.S.C. 154(b) by 0 days.

(21) Appl. No.: 09/457,146

(22) Filed: Dec. 9, 1999

(51) Int. Cl.[7] ..... A43D 3/00
(52) U.S. Cl. ..... 12/128 R; 12/114.2
(58) Field of Search ..... 12/128 R, 128 H, 12/128 B, 114.2, 115.8

(56) References Cited

U.S. PATENT DOCUMENTS 885,609 * 4/1908 Gough ..... 12/128 R
896,536 * 8/1908 Hayden ..... 12/114.2
2,262,621 * 11/1941 Reinhardt ..... 12/128 R
2,975,444 * 3/1961 Drew ..... 12/128 R
3,131,036 * 4/1964 Hirschberg ..... 12/128 B
4,718,135 * 1/1988 Colvin ..... 12/115.8
5,671,495 * 9/1997 Chen ..... 12/146 R

* cited by examiner

*Primary Examiner*—Paul T. Sewell
*Assistant Examiner*—Jila Mohandesi
(74) *Attorney, Agent, or Firm*—Harrison & Egbert

(57) ABSTRACT

An apparatus having a shoe and a shoe insert. The shoe insert is removably positioned within a toe portion of the shoe. The shoe insert is of a hollow construction and opens across a bottom of said shoe insert. The shoe insert has a shape which matches the shape of an interior of the toe portion. A handle portion having an inwardly extending ridge is formed at an end of the shoe insert. The handle has a size and shape suitable for grasping by human fingers.

3 Claims, 2 Drawing Sheets

SHOE INSERT

FIELD OF THE INVENTION

The present invention relates generally to a shoe insert, and more particularly to an improved structure of the shoe insert.

BACKGROUND OF THE INVENTION

A shoe insert is usually inserted at the front tip of the shoe to support the inner portion of said shoe, so as to display the shoe's surface straight and upright. Therefore, a shoe insert is very important to use inside the shoe, and many manufacturers would like to improve said shoe insert by shapes or materials.

Nowadays, various shapes and materials of the shoe insert can be found on the market. Among those materials are plastics, bubbles, and papers. However, the structure of the currently used shoe linings can be divided into paper ball-shaped or plastic or bubble plate-shaped. Such structures are defective in design as described hereinafter.

1. The paper ball-shaped shoe insert is taken from waste paper. Such structure is defective for the support in standing up the shoe surface is not durable.
2. The plastic plate-shaped shoe insert is rather sturdy, but it can not be decomposed naturally and will cause an environmental protection problem.
3. The bubble plate-shaped shoe insert is lightweight, but it also can not provide durable support for the shoe surface and can not overcome the environmental protection problem.

SUMMARY OF THE INVENTION

The primary objective of the present invention to provide an improved shoe insert structure which is free from the shortcomings of the conventional shoe insert described above.

The structure of the present invention is an improved shoe insert has a hollow construction which opens across the bottom. The shoe insert has an exterior shape which is open and similar in shape to the space in the inner portion of the shoe. The shoe insert is provided with a handle portion at one end thereof.

The features, functions, and advantages of the present invention will be readily understood upon a thoughtful deliberation of the following detailed description of the embodiments of the present invention with reference to the accompanying drawings.

DETAILED DESCRIPTION OF THE INVENTION

Figure 1:
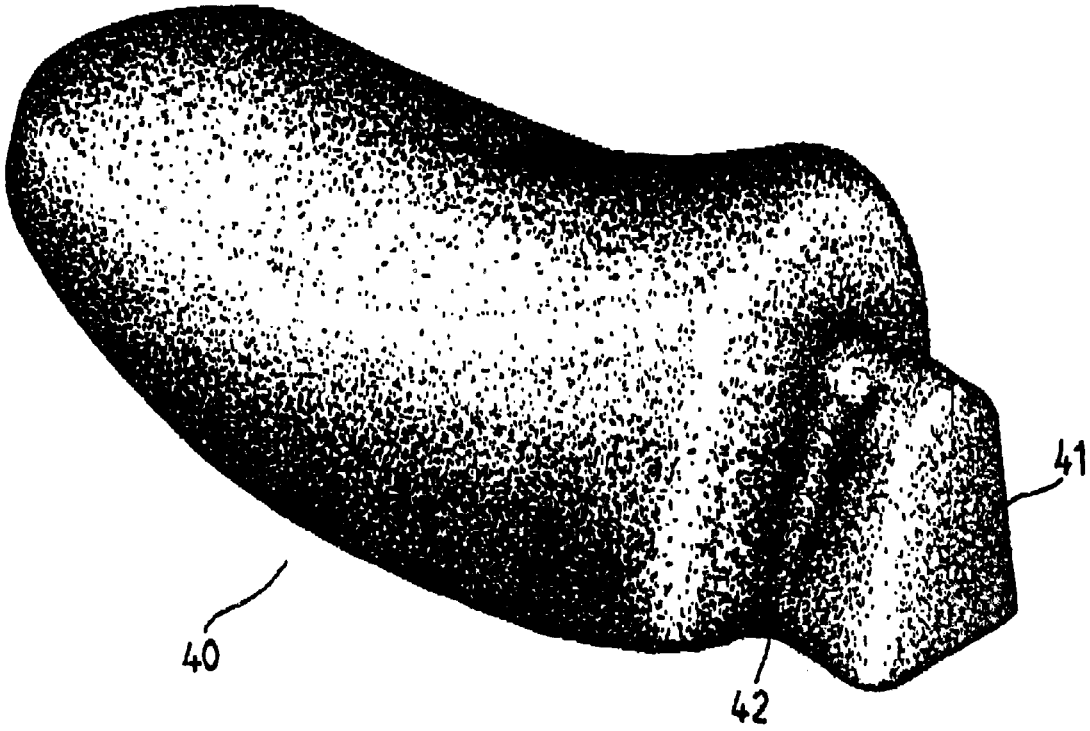
FIG. 1 shows a perspective view of the present invention.
Figure 2:
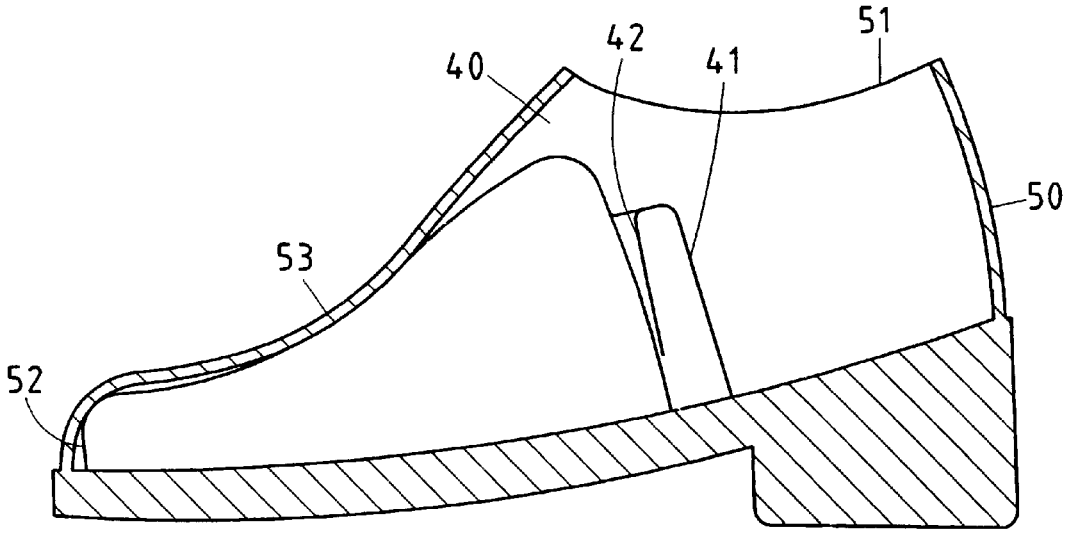
FIG. 2 shows a sectional view of a structure of the present invention.

As shown in FIGS. 1 and 2, a shoe insert 40 is of a hollow construction which opens across the bottom thereof. The shoe insert has an exterior shape which is similar to the toe portion inside the shoe. A handle portion 41 is formed at one end of the shoe insert 40 provided with a concave ridge 42 between the handle portion 41 and the end of the shoe insert 40. The handle portion 41 extends outwardly from the end of the shoe insert 40 for a suitable distance to facilitate the ability to grasp the handle portion 41 for inspection, installation and removal of the shoe insert 40.

When the present invention is in using condition (as shown in FIG. 2), the shoe insert 40 can be easily taken in or out from the outlet 51 of the leather shoe 50 by grasping to manipulate the handle portion 41 the shoe insert 40. At the same time of the shoe insert 40 is inserted into the inner portion of the leather shoe 50, and when the structure of the shoe insert 40 is same as the toe's space 52 of the front leather shoe 50, the shoe lining 40 supports the surface 53 of the leather shoe 50 so that it is straight and upright.

It is a feature of the present invention wherein said shoe insert 40 can reduce humidity while the leather shoe 50 is wet, and that said shoe insert 40 can be used again after being air-dried or sun-dried.

Figure 3:
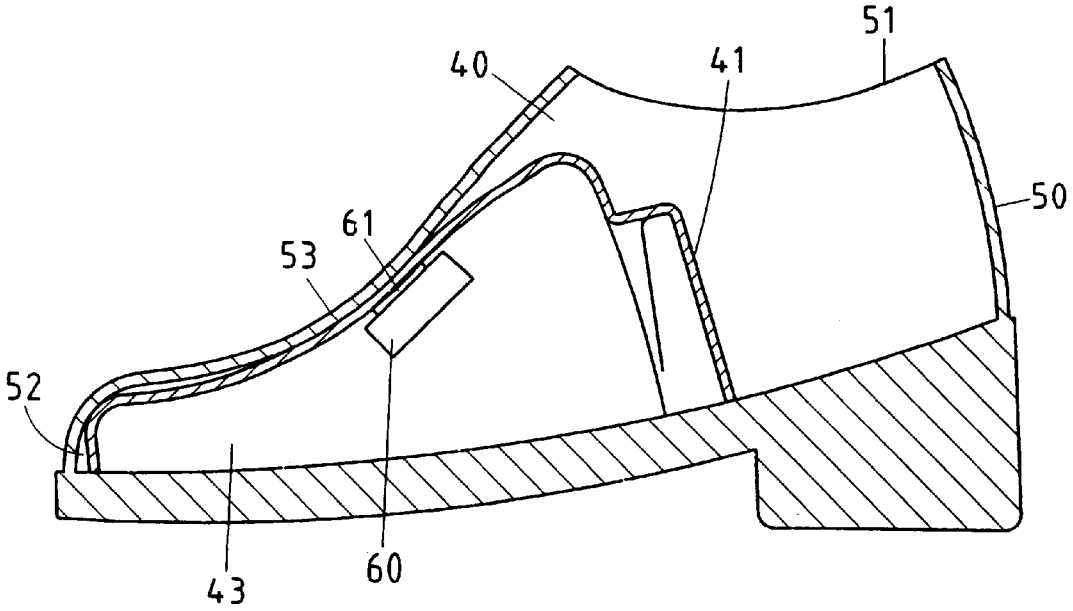
FIG. 3 shows another sectional view of the structure of the present invention.

It is another feature of the present invention wherein the shoe insert 40 can hold a fragrance element 60 inside itself to rid foul smell adhered in the hollow bottom portion 43 of the shoe insert 40 by using an adhesive element 61 (as shown in FIG. 3). So that the inner portion of the leather shoe 50 smells sweet and prevents bacteria from breeding.

It is still another feature of the present invention wherein said shoe insert 40 is molded from the liquid of recycled waste paper (the mold processing is not applied in the claims, therefore it is not described more in the description). Such structure is stronger than the structure of paper ball-shaped or plate-shaped linings, and more efficient in moisture absorption. The present invention can be recycled after used because it will not effect the environmental protection problem.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. An apparatus comprising:

a shoe having an outlet and a toe portion;

a shoe insert removably received within said toe portion of said shoe, said shoe insert being of a hollow construction and opening across a bottom thereof, said shoe insert having a shape matching a shape of an interior of said toe portion; and a handle portion formed and integral with said shoe insert and extending outwardly from an end thereof, said handle portion having a concave inwardly extending ridge adjacent said end of said shoe insert, said handle portion being graspable by human fingers such that said shoe insert can be removed through said outlet.

2. The apparatus of claim 1, said shoe insert and said handle portion being integrally formed together of a recycled paper material.

3. The apparatus of claim 1, said handle portion being hollow and opening at a bottom thereof, said ridge extending around said handle portion above said bottom.

* * * * *